United States Patent [19]

Jette

[11] 4,360,160

[45] Nov. 23, 1982

[54] SHOWERHEAD CONTROL ADAPTER

[76] Inventor: Emile Jette, 1328 NE. 110 Ter., Miami, Fla. 33161

[21] Appl. No.: 57,665

[22] Filed: Jul. 16, 1979

Related U.S. Application Data

[63] Continuation-in-part of Ser. No. 868,200, Jan. 9, 1978, which is a continuation-in-part of Ser. No. 818,441, Jul. 25, 1977, abandoned, which is a continuation-in-part of Ser. No. 790,277, Apr. 25, 1977, abandoned, which is a continuation-in-part of Ser. No. 743,766, Nov. 22, 1976, abandoned.

[51] Int. Cl.[3] ..... B05B 1/30

[52] U.S. Cl. ..... 239/289; 4/596; 239/562; 239/579; 239/587; D23/35

[58] Field of Search ..... 239/587, 579, 562, 289; D23/35; 137/555; 4/145, 146, 148, 151, 153, 154, 155, 596, 597, 615, 518

[56] References Cited

U.S. PATENT DOCUMENTS

| | | | |
|---|---|---|---|
| D. 161,431 | 1/1951 | Derbyshire | 239/273 |
| D. 208,244 | 8/1967 | Poole | D23/35 |
| 2,776,168 | 1/1957 | Schweda | 239/587 |
| 3,047,239 | 7/1962 | Canavan | 239/587 |

FOREIGN PATENT DOCUMENTS

| | | | |
|---|---|---|---|
| 353605 | 10/1937 | Italy | 239/587 |

*Primary Examiner*—Robert B. Reeves
*Assistant Examiner*—Michael J. Forman

[57] ABSTRACT

A showerhead control adapter which includes an elongate or remote handle extending outwardly and generally downwardly from the adapter to permit a user to selectively position said showerhead to direct a water discharge flow therefrom to a desired area or location, and a valve structure in the adapter to, optionally, shut off or turn on water supply passing through the adapter by movement of it from an "in-use" position to a "closed" position. This is accomplished without disrupting the hot and cold water mixture in the supply conduit to the showerhead. The adapter includes a first portion or fitting for threaded engagement with the water supply pipe and a second portion for threaded engagement with a conventional showerhead and a universal joint connection between the fitting and the tubular body providing a flow through path or passage which is controlled by the valve structure.

3 Claims, 3 Drawing Figures

SHOWERHEAD CONTROL ADAPTER

This application is a continuation-in-part of Ser. No. 868,200, filed Jan. 9, 1978, which is a continuation-in-part of Ser. No. 818,441, filed July 25, 1977, now abandoned, which is a continuation-in-part of Ser. No. 790,277, filed Apr. 25, 1977, now abandoned, which is in turn a continuation-in-part of Ser. No. 743,766, filed Nov. 22, 1976, now abandoned.

FIELD OF THE INVENTION

This invention pertains to showerheads and, more particularly, to an adapter providing an elongate handle to control the positioning of the showerhead relative to a user and including a valve means in the adapter whereby the water supply may be selectively shut off by moving the handle to a neutral position.

BACKGROUND OF THE PRESENT INVENTION

Showerheads are generally connected to a source of water supply by a ball and socket connection or universal joint. The ball, in a conventional installation, is fixed to the end of a water supply pipe, projecting outwardly of a wall in a bathtub or shower enclosure.

This invention is of an adapter to be connected in fluid flow relation between the water supply pipe and the showerhead and which includes a valve means for selectively opening and closing the flow path through the adapter and hence the water supply from the showerhead.

The instant invention includes a ball and socket type valve means of the type described hereinafter and an elongate operator whereby the relative movement for opening and closing the valve means may be achieved by manipulation of the terminal end of the elongate operator which is conveniently located.

Generally, individual hot and cold faucets or a single lever type of faucet is connected to hot and cold water conduits from a source of supply. The faucet or faucets must be manipulated to a proper hot and cold water mixture to achieve a desired water temperature. The mixed water then enters a single conduit to the showerhead where it passes through a discharge port in the connector ball and then outwardly in a spray form through anyone of a variety of spray structures depending upon the maker of the spray head.

To adjust the direction of spray, a user must physically grasp any of the single or multiple outlet spray heads provided with the above-described ball and socket connections and turn it to a desired position. If a user desires to shut off the water supply while "soaping up" or shampooing his or her hair, the faucet or faucets must be turned off and then turned on and readjusted to a desired hot and cold water mixture for the rinsing-off operation. Since this is an uncomfortable and time-consuming operation, it is rarely done, with attendant waste of water and heat energy. Particularly in relatively small bathtubs and shower enclosures, generally provided in most bathrooms, it is very difficult to evade the shower spray while soaping-up or shampooing the hair.

The device of the present invention provides an elongate handle, generally in the form of a rod, with a protective ball on the extended end, in an integral or fixed relation to the adapter to permit a user to universally position the showerhead within predetermined limits. The socket of the ball and socket connection is formed in a manner so as to provide a shut-off valving means when the adapter by means of the extended handle is moved to a peripheral limit position. This is accomplished without upsetting the hot and cold water mixture, and a user need only to push the handle to a movement limit position to shut the water off, and to move the showerhead back to a normal in-use position to turn the water on. The faucet or faucets need no further manipulations and, if desired, a user or users need never operate the faucet or faucets to off positions. The water flow may be shut off by means of the adapter and in each subsequent use, the adapter may be manipuated to an "on" position and immediately provide water of a desired temperature.

Therefore, one of the principal objects of the present invention is to provide a generally downwardly extending handle means in the form of an elongated extension from the adapter to universally manipulate or position the showerhead within a limited, predetermined range of movement.

Another principal object of this invention is to provide valve means in the adapter, operable by said handle means, to shut off the flow of water therethrough when the adapter is moved to a peripheral zone in said range of movement and to turn on the flow of water when said adapter is moved to any position within a central zone of the movement range, the entire range of movement defining a generally circular pattern.

Another object of the invention is to provide the valve means completely independent of the faucet or faucets controlling the flow of hot and cold water from sources of supply.

A further object of the invention is to provide a protective ball on the extended end of the handle.

A still further object of the present invention is to provide hook means along the length of the handle.

DESCRIPTION OF THE PREFERRED EMBODIMENT

Figure 1:
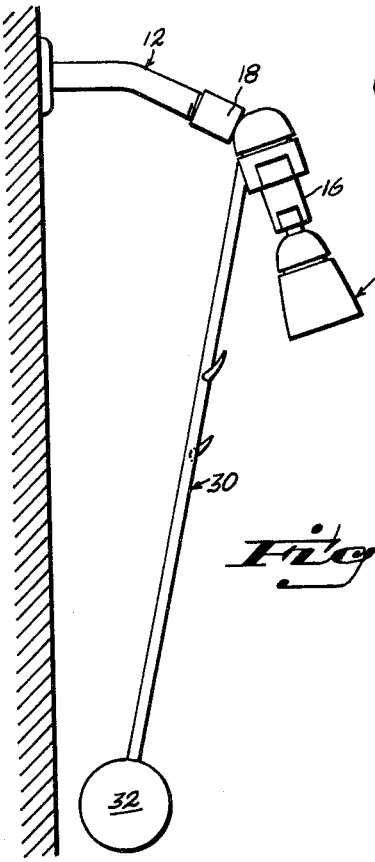
FIG. 1 is a side elevation view illustrating the installation of the instant invention.

Referring to the drawings wherein like reference characters designate like or corresponding parts throughout the several views, there is shown in FIG. 1 a waterline supply pipe generally designated by the numeral 12 and a showerhead structure generally designated by the numeral 14. In the conventional prior art, the showerhead structure 14 is provided with a female coupling 16 for threaded engagement on the terminal end zone 18 of the water supply pipe; the showerhead female coupling is internally threaded as at 79 for threaded engagement on the threaded end of the water supply pipe in a conventional installation.

The present invention is of an adapter generally designated by the numeral 20 which, as shown in the drawings is intended to be interposed between (a) the terminal end 18 of the water supply pipe 12, and (b) the female coupling 16 of the showerhead structure.

The adapter is composed, generally speaking, of three principal elements: first, a fitting 22 in threaded engagement on the end of the water supply pipe 12; second, a tubular body 24 with a nose portion for threaded engagement in the threaded female recess of the showerhead structure 14 in threaded engagement with the threads 79 of the female coupling 16; and third, a swivel means, which may be in the form of a ball and socket type connection as shown, for interconnecting the fitting 22 and the tubular body 24 so as to permit a range of relative movement of a universal nature.

Figure 2:
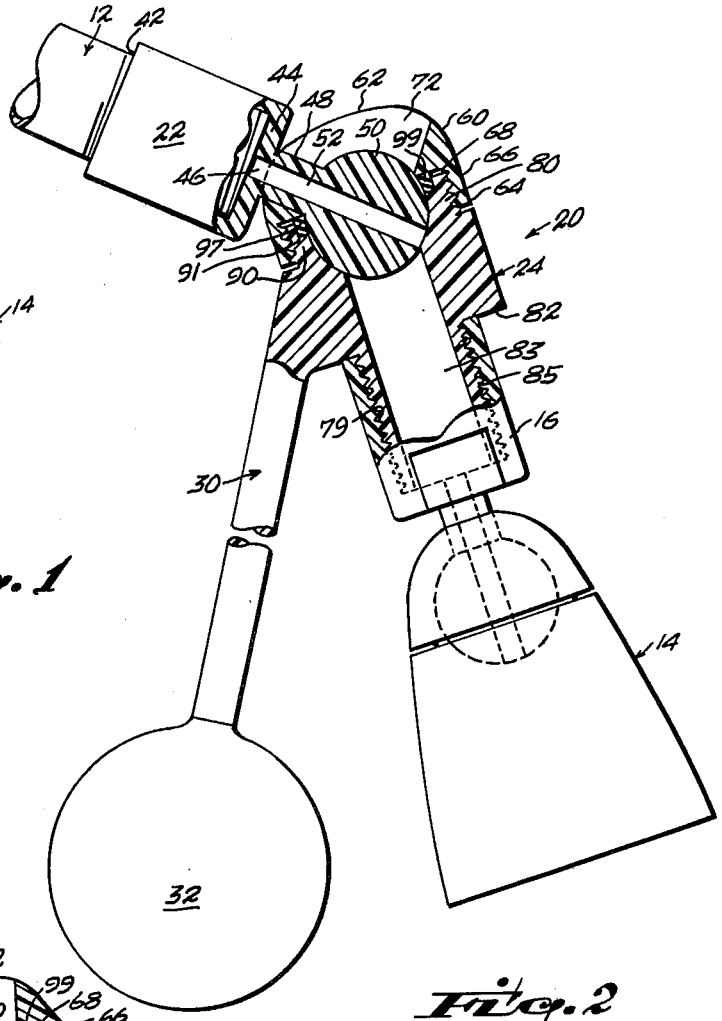
FIG. 2 is a view which is partly in cross section of the showerhead zone of FIG. 1.
Figure 3:
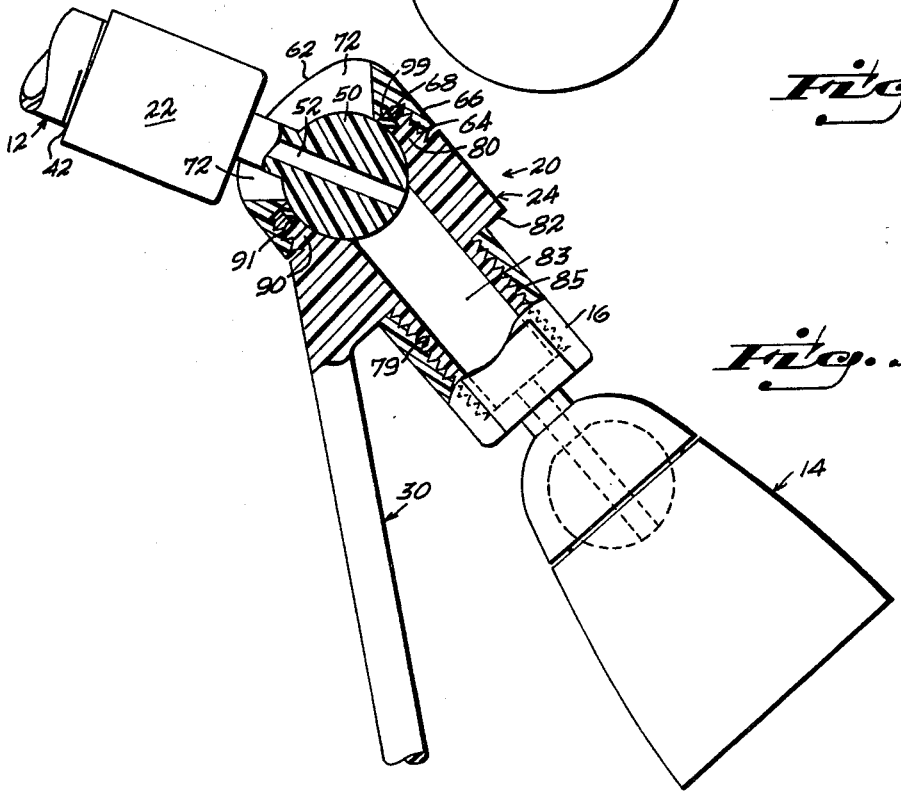
FIG. 3 is a view in cross section similar to FIG. 2 and illustrating the device in a flow through or on position in contrast to the closed position of the water flow shown in FIG. 2.

Referring to the structure it is seen upon a comparison of FIGS. 2 and 3 that, by moving the showerhead portion through a portion of the range of movement permitted by the swivel means, a water flow path is adapted to be open, as shown in FIG. 3, or, optionally, during another portion of the range of movement, as shown in FIG. 2, the path is closed to water flow from the supply pipe to the showerhead.

Finally, it should be pointed out that an operator means is provided for manipulating the adapter so as to open and close the water flow path. In the preferred embodiment the operator means comprises an elongate downwardly extending member generally designated by the numeral 30 which preferably terminates at a lower bulbous or enlarged portion 32 which can conveniently be reached by a person, for example, sitting in a tub of water, such as a handicapped person or, alternatively, it may conveniently be manipulated to turn the water flow on or off when a person is standing in a shower, so that in one movement water may be conserved and, with it, heat energy of the heated water, so that, less water is used and less heat energy is wasted.

With more particular reference to FIG. 2, wherein a preferred embodiment of the invention is illustrated, it is seen that the fitting 22 includes a cylindrical internally threaded member having an open end 42 and a closed end 44 with a through opening 46. Further, the fitting includes an axially extending neck portion 48 terminating at a distal ball 50 of predetermined diameter, there being an axial passageway 52 through the ball neck and this passageway includes the opening 46 in the end wall of the fitting.

In the preferred embodiment a cap 60 is provided which has a first end 62 and a second end 64, the second end comprising a skirt 66 which is internally threaded as at 68; and the first end 62 is provided with an annular frustoconical shaped recess 72 with the narrower zone thereof defining an opening of a radius less than that of the radius of the ball and wherein the radius of curvature is substantially similar to that of the radius of the ball. The cap is captivated on the ball with the neck and ball extending through the enlarged frustoconical opening 72 at the first end 62.

The aforementioned tubular body 24 comprises an annular member which has a first end 80 and a second end 82. The second end 82 includes an axially extending projection 83 which is externally threaded as at 85, said threads being sized for receipt in threaded engagement with the threads 79 of the skirt 84 of the showerhead female coupling 16. The first end 80 of the tubular body includes an axially depthwise extending spherical recess to receive the ball; and it includes an axially extending radially outwardly disposed wall 90 which is externally threaded for threaded engagement in the threaded end of the cap 60.

It is thus seen that by movement of the ball or bulbous body 32 on the lower end of the elongate rod 30, the direction of water flowing from the tubular body may be altered and that the body may be moved into a closed position, as shown in FIG. 2 or, alternatively into the open position as shown in FIG. 3. It will be seen that a seal means 97 in the form of an annular washer 99 is provided intermediate the periphery of the ball and the cap, and the same being captivated on an annular shoulder 91 in the wall 90 upon advancement of the threaded end 80 of the tubular body 24. It should be pointed out that the seal is effective to stop backflow of water and that in the embodiment there is a sufficiently large tolerance between the external surface of the ball and the internal surface of the socket so that substantial closing of the water path takes place; however, a slow trickle will be maintained at all times which serves as a trickle leak and prevents a cross flow between the hot and cold lines serving the water supply pipe.

It is thus seen that there has been provided an adapter which includes a first portion to be connected to the threaded end of a water supply pipe, a second portion with an operator extending from it which is to be connected to a showerhead and mutually intercooperating swivel means connecting these two portions together so that, when the operator is manipulated, the showerhead may be moved to any desired position and, additionally, opened and closed with respect to waterflow through it. The elongate rod 30 may be integrally connected to the tubular body or, optionally, be removably attached to it for use as desired.

It is thus seen that there has been provided a simple and inexpensive adapter whereby in existing shower facilities, the adapter may be inserted between the water supply pipe and the showerhead and that, thereafter, the water may be conveniently turned off from a relatively remote location and the spray be adjusted with respect to direction to conserve water and, additionally, energy necessary for heating that water.

What is claimed is:

1. A remote control device to control fluid flow through a showerhead and comprising an adapter in combination with a showerhead for use at a showerhead installation having a vertical surface with a water supply pipe having a threaded downstream end projecting from the vertical surface wherein the threaded downstream ends defines a normal flow path to direct a stream of water of preselected temperature outwardly and downwardly from the plane of the vertical surface, said showerhead having a through bore and an upstream end with a female threaded socket sized to mate in fluid flow relation with the threaded end of the supply pipe and a downstream water flow exit opening and said showerhead including diffuser means to diffuser water flowing through the showerhead at said exit opening, said adapter comprising, a fitting having an open upstream end and a downstream end and defining a generally cylindrical wall, said open upstream end of said fitting being sized and companionately threaded internally for threaded engagement to the threaded downstream end of the water supply pipe, said fitting having a centerline between the ends, and the centerline of said fitting when in threaded engagement with the downstream end of said water supply pipe being coincident with the centerline of said downstream end of said water supply pipe, a generally tubular body having a longitudinal centerline and said body having an upstream end and a downstream end, and a through bore defining a flow through path between the ends, said downstream end defining a cylindrical externally threaded nose and said nose being sized for threaded engagement in the female socket of the showerhead structure with the centerline of said tubular body being coincident with a centerline through the showerhead and along the flow path, swivel joint means captivatingly connecting the fitting and the tubular body for swinging movement of the tubular body when connected to a showerhead relative to the fitting through a predetermined range of swinging movement and comprising mutually interengaging means defining a flow path communicating between the interior of the fitting and the bore of the tubular body, said adapter including an elongate operator member extending downstream of the tubular body and substantially beyond the downstream end in diverging relation with respect to the centerline of the tubular body, said mutually intercooperating means comprising an outwardy extending portion defining a neck on said fitting in axial alignment with said fitting, said neck having a through bore and terminating in a distal spherical head portion, said head portion having a through bore aligned with the through bore of said neck, and wherein an annular threaded connection member is provided on said tubular body, said tubular body having an externally threaded upstream end, said connection member having an open end defining an annular shoulder and being captivated on said neck and head portion, said mutually interengaging means comprising valve means and said valve means including upstream facing surfaces on said tubular body in blocking engagement of said through bore of said spherical head portion when said elongate operator member is swingably moved such that the operator member is closely adjacent said vertical surface and swingable so that the bore is in fluid communication with the through bore of the tubular body when said member is swingably moved away from said vertical surface to permit waterflow to the showerhead, and seal means captivated between said tubular body, said head portion and said annular threaded connection member to restrain fluid flow to downstream flow when said surface of said tubular body is in blocking relation of the through bore of said head portion, said valve means including means to provide a water trickle leak therethrough when in said valve closed position to prevent a cross flow of water between the hot and cold water supply lines.

2. The device as set forth in claim 1 wherein an enlarged bulbous portion is provided on the lower end of said elongate member.

3. The device as set forth in claim 1 wherein hook means are provided intermediate the length of said elongate member.

* * * * *